US008281450B2

(12) United States Patent
Spain

(10) Patent No.: US 8,281,450 B2
(45) Date of Patent: Oct. 9, 2012

(54) POWDER APPLICATOR

(76) Inventor: Jermaine D. Spain, Chula Vista, CA (US)

( * ) Notice: Subject to any disclaimer, the term of this patent is extended or adjusted under 35 U.S.C. 154(b) by 1132 days.

(21) Appl. No.: 12/132,851

(22) Filed: Jun. 4, 2008

(65) Prior Publication Data

US 2009/0300865 A1 Dec. 10, 2009

(51) Int. Cl.
*A46B 15/00* (2006.01)
*A45D 33/34* (2006.01)

(52) U.S. Cl. ..... 15/229.14; 15/104.93; 15/244.3

(58) Field of Classification Search ..... 15/104.93, 15/229.14, 244.3
See application file for complete search history.

(56) References Cited

U.S. PATENT DOCUMENTS

| | | | | |
|---|---|---|---|---|
| 2,159,227 | A * | 5/1939 | Reiffert et al. | 15/229.14 |
| 2,350,707 | A | 6/1944 | Vaughn | |
| 2,382,169 | A * | 8/1945 | Pena | 156/88 |
| 2,763,021 | A * | 9/1956 | Levy-Hawes et al. | 15/229.14 |
| 2,932,052 | A * | 4/1960 | Morse | 15/229.14 |
| 4,698,871 | A * | 10/1987 | Patkos | 15/118 |
| 6,223,787 | B1 | 5/2001 | Graham | |
| 6,283,664 | B1 | 9/2001 | Gueret | |

* cited by examiner

*Primary Examiner* — Randall Chin
(74) *Attorney, Agent, or Firm* — Dale J. Ream

(57) ABSTRACT

A powder applicator includes first and second sheets of flexible material, each sheet having a circular configuration with an external perimeter and having a porous section. The powder applicator also includes an absorbent disc having a predetermined amount of powder. The first sheet external perimeter is coupled to the second sheet external perimeter and the absorbent disc is sandwiched between the first and second sheets.

3 Claims, 2 Drawing Sheets

POWDER APPLICATOR

BACKGROUND OF THE INVENTION

This invention relates generally to infant accessories and, more particularly, to a powder applicator for applying powder to an infant in a manner such that the powder is applied when and where it is intended and without making an undue mess or requiring excessive cleanup.

Parents and care givers frequently desire to apply powder to a baby's bottom or to deposit powder into a diaper so as to minimize the effects of diaper rash or chapped skin. Unfortunately, applying baby powder to an infant after changing a diaper or after a bath often results in powder being spilt on clothing, the floor, and sometimes in seemingly every location other than where it was intended.

Various devices have been proposed in the art for applying powder to a baby's skin. Although assumably effective for their intended purposes, the existing devices do not hold enough powder for multiple repeated uses, do not inhibit release of powder so as to minimize unintended application, or are not soft enough to be appropriate for contact with an infant's skin.

Therefore, it would be desirable to have a powder applicator that retains enough powder for multiple applications. Further, it would be desirable to have a powder applicator that inhibits unintended application of powder and thus minimizes making a mess. In addition, it would be desirable to have a powder applicator that is safe and comfortable for contact with a baby's skin.

SUMMARY OF THE INVENTION

Therefore, a powder applicator according to the present invention includes first and second sheets of flexible material, each sheet having a circular configuration with an external perimeter and having a porous section. The powder applicator also includes an absorbent disc having a predetermined amount of powder. The first sheet external perimeter is coupled to the second sheet external perimeter and the absorbent disc is sandwiched between the first and second sheets.

DESCRIPTION OF THE PREFERRED EMBODIMENT

A powder applicator will now be described in detail with reference to FIG. 1 through FIG. 2*b* of the accompanying drawings. More particularly, the powder applicator 100 includes first and second sheets of flexible material 110, 120 and a pad 130. The pad 130 includes a predetermined amount of powder (e.g., baby powder).

Figure 1:
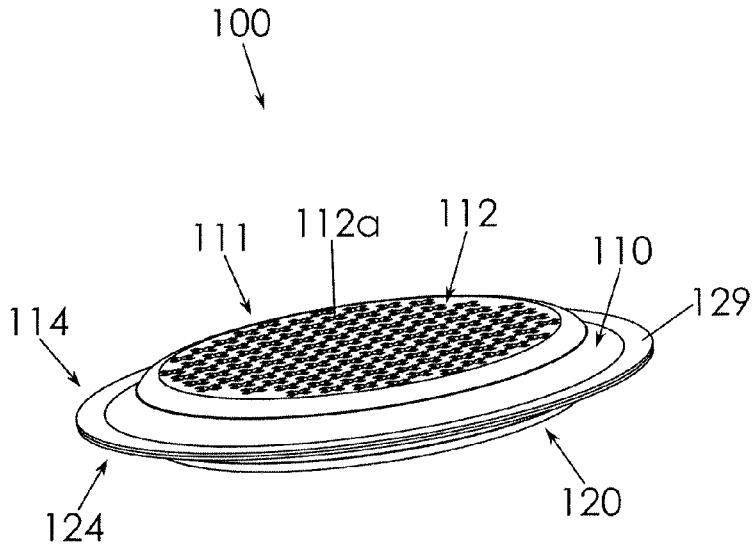
FIG. 1 is a perspective view of a powder applicator according to a preferred embodiment of the present invention.

As shown in FIGS. 1 and 2, the first sheet 110 has a porous section 112 and an external perimeter 114, and the second sheet 120 has a porous section 122 and an external perimeter 124. The perimeter 114 of the first sheet 110 may be configured substantially the same as the perimeter 124 of the second sheet 120, and both sheets 110, 120 may (for example) have a circular configuration.

Figure 2A:
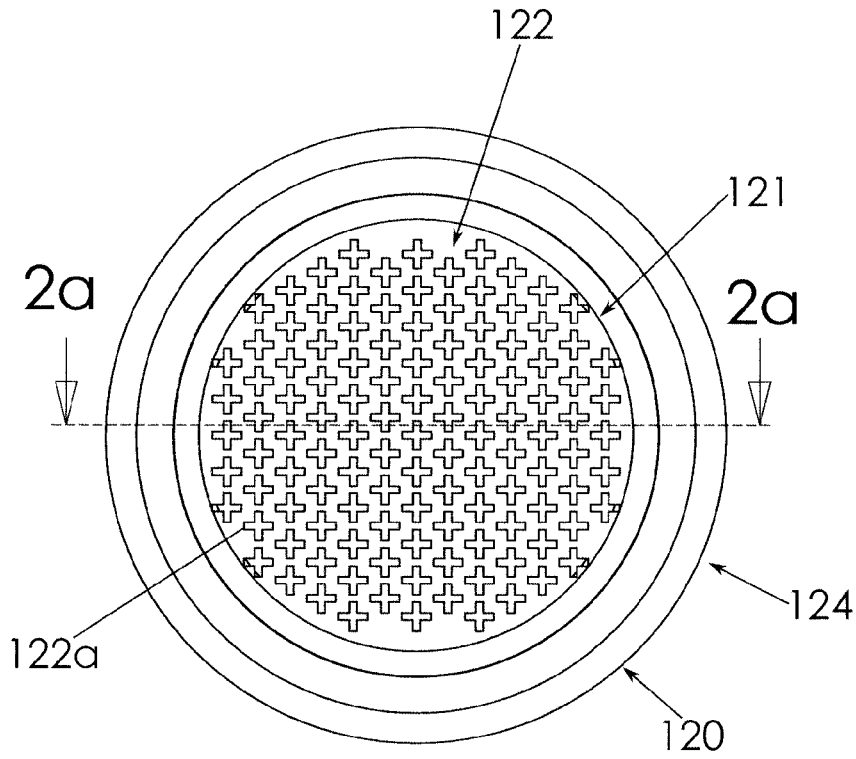
FIG. 2*a* is a top view of the powder applicator as in FIG. 1.
Figure 2B:
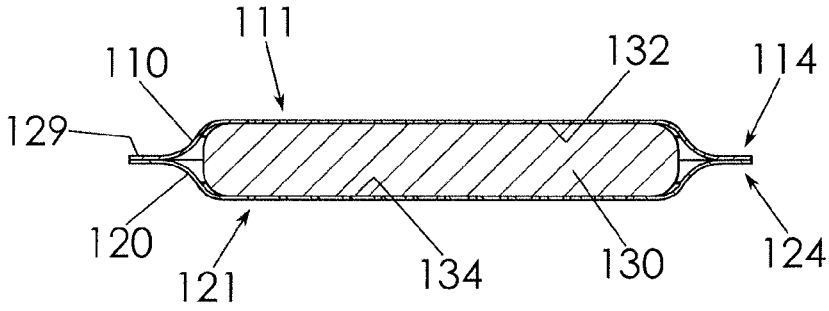
FIG. 2*b* is a sectional view of the powder applicator as in FIG. 1 taken along lines 2*a*-2*a* of FIG. 2*a*.

The first sheet 110 may define a first sheet upper region 111 that includes the porous section 112 (FIG. 1), and the second sheet 120 may define a second sheet lower region 121 that includes the porous section 122 (FIG. 2*a*). Each porous section 112, 122 includes a plurality of perforations 112*a*, 122*a* configured to retain the powder when at rest and allow the powder to pass through when agitated.

The first and second sheets 110, 120 collectively sandwich the pad 130 (FIG. 2*b*), and the first sheet 110 may be coupled to the second sheet 120 to maintain the pad 130 between the first and second sheets 110, 120. The first sheet external perimeter 114 may be coupled to the second sheet external perimeter 124. In at least one embodiment, as shown in FIG. 1, the first and second sheets 110, 120 collectively define a generally planar ring 129 where the first sheet 110 is coupled to the second sheet 120. The first and second sheets 110, 120 may be constructed of cloth or any other appropriate material.

The pad 130 may be an absorbent disc and may have generally planar upper and lower surfaces 132, 134. As shown in FIG. 2*b*, the upper surface 132 may be adjacent the first sheet upper region 111, and the lower surface 134 may be adjacent the second sheet lower region 121. In at least one embodiment, the pad 130 is resilient, and the pad 130 may be constructed of a sponge or any other appropriate material.

In one embodiment of manufacturing the powder applicator 100, the powder (e.g., baby powder) is introduced to the pad 130, the first and second sheets 110, 120 are positioned to sandwich the pad 130, and the first sheet external perimeter 114 is coupled to the second sheet external perimeter 124 (e.g., by stitching, adhesive, or any other appropriate method). The external perimeters 114, 124 may be defined before the first and second sheets 110, 120 are positioned to sandwich the pad 130, or larger pieces of material may be used with multiple pads 130 to create multiple powder applicators 100. Each powder applicator 100 may be packaged individually, or multiple powder applicators 100 may be packaged together. The generally planar nature of the upper and lower regions 111, 121 may allow multiple powder applicators 100 to be easily stacked atop one another.

In use, the powder applicator 100 may be rubbed, patted, or otherwise placed in contact with a surface needing powder (e.g., a baby's skin). The perforations 112*a*, 122*a* may separate and allow powder to pass through when agitated by the contact (FIG. 2*a*) and may close and maintain the powder inside the first and second sheets 110, 120 when not agitated. Because the pad 130 includes the powder, the user does not have to add the powder to the outside of the applicator 100. Having perforations 112*a* on sheet 110 and perforations 122*a* on sheet 120 may allow the user to contact the surface with either sheet 110, 120; in other words, the user does not have to determine which sheet 110, 120 should contact the surface needing powder.

It is understood that while certain forms of this invention have been illustrated and described, it is not limited thereto except insofar as such limitations are included in the following claims and allowable functional equivalents thereof.

The invention claimed is:

1. A powder applicator, comprising:

first and second sheets of flexible material, each sheet having a circular configuration with an external perimeter, each sheet having a porous section;

an absorbent disc having a predetermined amount of powder, said absorbent disc including powder introduced onto said pad at a point of manufacture;

wherein said first sheet external perimeter is coupled to said second sheet external perimeter and said disc is sandwiched between said first and second sheets at said point of manufacture:

wherein:

said first sheet defines a generally planar upper region;

said second sheet defines a generally planar lower region;

said upper region includes said first sheet porous section;

said lower region includes said second sheet porous section;

each said porous section includes a plurality of perforations configured to retain said powder when at rest and allow said powder to pass through when agitated;

said first and second sheets collectively define a generally planar ring surrounding said first and second sheet porous sections, said first sheet being coupled to said second sheet at said ring;

said ring extends outwardly from said first and said second sheet porous sections;

said ring does not include perforations; and said plurality of perforations are situated only in upper and lower regions of said first and second sheets, respectively.

2. The powder applicator of claim 1, wherein said absorbent disc is resilient.

3. The powder applicator of claim 2, wherein:

said absorbent disc is constructed of a sponge;

said first and second sheets are constructed of cloth; and said first sheet external perimeter is configured substantially the same as said second sheet external perimeter.

* * * * *